US006177392B1

(12) United States Patent
Lentsch et al.

(10) Patent No.: US 6,177,392 B1
(45) **Date of Patent: *Jan. 23, 2001**

(54) STABLE SOLID BLOCK DETERGENT COMPOSITION

(75) Inventors: Steven E. Lentsch, St. Paul; Keith E. Olson, Apple Valley; G. Jason Wei, Mendota Heights, all of MN (US)

(73) Assignee: Ecolab Inc., St. Paul, MN (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 08/781,493

(22) Filed: Jan. 13, 1997

(51) Int. Cl.[7] ..... C11D 17/00; C11D 3/10; C11D 3/36

(52) U.S. Cl. ..... 510/224; 510/228; 510/451; 510/467

(58) Field of Search ..... 510/224, 228, 510/451, 467

(56) References Cited

U.S. PATENT DOCUMENTS

| | | | | |
|---|---|---|---|---|
| Re. 32,763 | | 10/1988 | Fernholz et al. | 252/90 |
| 1,580,576 | | 4/1926 | Weidner . | |
| 1,949,264 | | 2/1934 | Bagley | 226/69 |
| 2,412,819 | | 12/1946 | MacMahon | 252/138 |
| 2,920,417 | | 1/1960 | Wertheimer | 45/25 |
| 2,927,900 | | 3/1960 | Shiraeff | 252/152 |
| 2,987,483 | | 6/1961 | Brooker | 252/138 |
| 3,306,858 | | 2/1967 | Oberle | 252/99 |
| 3,351,558 | * | 11/1967 | Zimmerer | 510/228 |
| 3,382,178 | | 5/1968 | Lissant et al. | 252/135 |
| 3,390,092 | | 6/1968 | Keast et al. | 252/99 |
| 3,390,093 | | 6/1968 | Feierstein et al. | 252/138 |
| 3,441,511 | | 4/1969 | Otrhalek | 252/135 |
| 3,491,028 | | 1/1970 | Crotty et al. | 252/103 |
| 3,557,003 | | 1/1971 | Morris et al. | 252/90 |
| 3,639,286 | | 2/1972 | Ballestra et al. | 252/109 |
| 3,816,320 | | 6/1974 | Corliss | 252/99 |
| 3,856,932 | | 12/1974 | May | 424/16.21 |
| 3,887,614 | | 6/1975 | Susuki et al. | 252/531 |
| 3,899,436 | | 8/1975 | Copeland et al. | 252/99 |
| 3,933,670 | | 1/1976 | Brill et al. | 252/99 |
| 3,939,386 | | 2/1976 | Croliss et al. | 252/99 |
| 3,985,669 | | 10/1976 | Krummel et al. | 252/116 |
| 4,000,080 | | 12/1976 | Bartolotia et al. | 252/99 |
| 4,072,621 | | 2/1978 | Rose | 252/89 |
| 4,083,795 | | 4/1978 | Joubert | 252/99 |
| 4,105,573 | | 8/1978 | Jacobsen | 252/99 |
| 4,147,650 | | 4/1979 | Sabatelli et al. | 252/103 |
| 4,148,603 | | 4/1979 | Schwuger et al. | 8/137 |
| 4,216,125 | | 8/1980 | Campbell et al. | 252/527 |
| 4,219,436 | | 8/1980 | Gromer et al. | 252/135 |
| 4,268,406 | | 5/1981 | O'Brien et al. | 252/105 |
| 4,274,975 | | 6/1981 | Corkill et al. | 252/140 |
| 4,276,205 | | 6/1981 | Ferry | 252/528 |
| 4,284,532 | | 8/1981 | Leikhim et al. | 252/528 |
| 4,329,246 | | 5/1982 | Gilbert et al. | 252/103 |
| 4,359,413 | | 11/1982 | Ward et al. | 252/527 |
| 4,587,031 | | 5/1986 | Kruse et al. | 252/135 |
| 4,595,520 | | 6/1986 | Heile et al. | 252/160 |
| 4,605,509 | | 8/1986 | Corkill et al. | 252/131 |
| 4,677,130 | | 6/1987 | Puzig | 514/389 |
| 4,680,134 | | 7/1987 | Heile et al. | 252/160 |
| 4,695,284 | | 9/1987 | Hight | 8/137 |
| 4,698,181 | | 10/1987 | Lewis | 252/527 |
| 4,725,376 | | 2/1988 | Copeland | 252/90 |
| 4,753,755 | | 6/1988 | Gansser | 252/527 |
| 4,846,993 | * | 7/1989 | Lentsch et al. | 510/228 |
| 4,983,315 | | 1/1991 | Glogowski et al. | 252/102 |
| 5,019,292 | | 5/1991 | Baeck et al. | 252/174.25 |
| 5,034,147 | | 7/1991 | Ramachandran | 252/95 |
| 5,061,392 | | 10/1991 | Bruegge et al. | 252/135 |

FOREIGN PATENT DOCUMENTS

| | | |
|---|---|---|
| 0 364 840 | 4/1990 | (EP) . |
| 687075 | 2/1953 | (GB) . |
| 61-87800 | 5/1986 | (JP) . |
| 92 02611 | 2/1992 | (WO) . |
| 95 18215 | 7/1995 | (WO) . |

* cited by examiner

*Primary Examiner*—Jerry D. Johnson
(74) *Attorney, Agent, or Firm*—Merchant & Gould P.C.

(57) ABSTRACT

The dimensionally stable alkaline solid block warewashing detergent uses an E-form binder forming a solid comprising a sodium carbonate source of alkalinity, a sequestrant, a surfactant package and other optional material. The solid block is dimensionally stable and highly effective in removing soil from the surfaces of dishware in the institutional and industrial environment. The E-form hydrate comprises an organic phosphonate and a hydrated carbonate.

35 Claims, 12 Drawing Sheets

STABLE SOLID BLOCK DETERGENT COMPOSITION

FIELD OF THE INVENTION

The invention relates to substantially inorganic mild alkaline detergent materials that can be manufactured in the form of a solid block and packaged for sale. In the manufacture of the solid detergent a detergent mixture is extruded to form the solid. The solid water soluble or dispersible detergent is typically uniformly dispensed, without undershoot or overshoot of detergent concentration, from a spray-on type dispenser which creates an aqueous concentrate by spraying water onto the soluble solid product. The aqueous concentrate is directed to a use locus such as a warewashing machine.

BACKGROUND OF THE INVENTION

The use of solid block detergents in institutional and industrial cleaning operations was pioneered in technology claimed in the Fernholz et al. U.S. Reissue Pat. Nos. 32,762 and 32,818. Further, pelletized materials are shown in Gladfelter et al., U.S. Pat. Nos. 5,078,301, 5,198,198 and 5,234,615. Extruded materials are disclosed in Gladfelter et al., U.S. Pat. No. 5,316,688. The solid block format is a safe, convenient and efficient product format.

In the pioneering technology, substantial attention was focused on how the highly alkaline material, based on a substantial proportion of sodium hydroxide, was cast and solidified. Initial solid block products (and predecessor powder products) used a substantial proportion of a solidifying agent, sodium hydroxide hydrate, to solidify the cast material in a freezing process using the low melting point of sodium hydroxide monohydrate (about 50° C.–65° C.). The active components of the detergent were mixed with the molten sodium hydroxide and cooled to solidify. The resulting solid was a matrix of hydrated solid sodium hydroxide with the detergent ingredients dissolved or suspended in the hydrated matrix. In this prior art cast solid and other prior art hydrated solids, the hydrated chemicals are reacted with water and the hydration reaction is run to substantial completion. The sodium hydroxide also provided substantial cleaning in warewashing systems and in other use loci that require rapid and complete soil removal. In these early products sodium hydroxide was an ideal candidate because of the highly alkaline nature of the caustic material provided excellent cleaning. Another sodium hydroxide and sodium carbonate cast solid process using substantially hydrated sodium materials was disclosed in Heile et al. U.S. Pat. Nos. 4,595,520 and 4,680,134.

Similarly, pioneering technology relating to the use of solid pelleted alkaline detergent compositions in the form of a water soluble bag assembly and an extruded alkaline solid material wrapped in a water soluble film has also been pioneered by Ecolab Inc. These products within the water soluble bag can be directly inserted into a spray on dispenser wherein water dissolves the bag and contacts the soluble pellet or extruded solid, dissolves the effective detergent ingredients, creates an effective washing solution which is directed to a use locus.

In recent years, attention has been directed to producing a highly effective detergent material from less caustic materials such as soda ash, also known as sodium carbonate, because of manufacturing, processing, etc. advantages. Sodium carbonate is a mild base, and is substantially less strong (has a smaller $K_b$) than sodium hydroxide. Further on an equivalent molar basis, the pH of the sodium carbonate solution is one unit less than an equivalent solution of sodium hydroxide (an order of magnitude reduction in strength of alkalinity). Sodium carbonate formulations were not given serious consideration in the industry for use in heavy duty cleaning operations because of this difference in alkalinity. The industry believed carbonate could not adequately clean under the demanding conditions of time, soil load and type and temperature found in the institutional and industrial cleaning market. A few sodium carbonate based formulations have been manufactured and solid in areas where cleaning efficiency is not paramount. Further solid detergents made of substantially hydrated, the carbonate content contained at least about seven moles of water of hydration per mole of carbonate, sodium carbonate were not dimensionally stable. The substantially hydrated block detergent tended to swell and crack upon aging. This swelling and cracking was attributed to changing of the sodium carbonate hydration states within the block. Lastly, molten hydrate processing can cause stability problems in manufacturing the materials. Certain materials at high melting temperatures in the presence of water can decompose or revert to less active or inactive materials.

Accordingly, a substantial need for mechanically stable solid carbonate detergent products, having equivalent cleaning performance when compared to caustic based detergents, has arisen. Further, a substantial need has arisen for successful non-molten processes for manufacturing sodium carbonate based detergents that form a solid with minimal amounts of water of hydration associated with the sodium base. These products and processes must combine ingredients and successfully produce a stable solid product that can be packaged, stored, distributed and used in a variety of use locations.

BRIEF DISCUSSION OF THE INVENTION

The invention involves a solid block detergent based on a combination of a carbonate hydrate and a non-hydrated carbonate species solidified by a novel hydrated species we call the E-form hydrate composition. The solid can contain other cleaning ingredients and a controlled amount of water. The solid carbonate based detergent is solidified by the E-form hydrate which acts as a binder material or binding agent dispersed throughout the solid. The E-form binding agent comprises at a minimum an organic phosphonate and water and can also have associated carbonate. The solid block detergent uses a substantial proportion, sufficient to obtain cleaning properties, of hydrated carbonate and non-hydrated carbonate formed into solid in a novel structure using a novel E-form binder material in a novel manufacturing process. The solid integrity of the detergent, comprising anhydrous carbonate and other cleaning compositions, is maintained by the presence of the E-form binding component comprising an organic phosphonate, substantially all water added to the detergent system and an associated fraction of the carbonate. This E-form hydrate binding component is distributed throughout the solid and binds hydrated carbonate and non-hydrated carbonate and other detergent components into a stable solid block detergent.

The alkali metal carbonate is used in a formulation that additionally includes an effective amount of a hardness sequestering agent that both sequesters hardness ions such as calcium, magnesium and manganese but also provides soil removal and suspension properties. The formulations can also contain a surfactant system that, in combination with the sodium carbonate and other components, effectively removes soils at typical use temperatures and concentrations. The block detergent can also contain other common additives such as surfactants, builders, thickeners, soil anti-redeposition agents, enzymes, chlorine sources, oxidizing or reducing bleaches, defoamers, rinse aids, dyes, perfumes, etc.

Such block detergent materials are preferably substantially free of a component that can compete with the alkali metal carbonate for water of hydration and interfere with solidification. The most common interfering material comprises a second source of alkalinity. The detergent preferably contains less than a solidification interfering amount of the second alkaline source, and can contain less than 5 wt %, preferably less than 4 wt %, of common alkalinity sources including either sodium hydroxide or an alkaline sodium silicate wherein the ratio $Na_2O:SiO_2$ is greater than or equal to about 1. While some small proportion sodium hydroxide can be present in the formulation to aid in performance, the presence of a substantial amount of sodium hydroxide can interfere with solidification. Sodium hydroxide preferentially binds water in these formulations and in effect prevents water from participating in the E-form hydrate binding agent and in solidification of the carbonate. On mole for mole basis, the solid detergent material contains greater than 5 moles of sodium carbonate for each total mole of both sodium hydroxide and sodium silicate.

We have found that a highly effective detergent material can be made with little water (i.e. less than 11.5 wt %, preferably less than 10 wt % water) based on the block. The solid detergent compositions of Fernholz et al. required depending on composition, a minimum of about 12–15 wt % of water of hydration for successful processing. The Fernholz solidification process requires water to permit the materials to fluid flow or melt flow sufficiently when processed or heated such that they can be poured into a mold such as a plastic bottle or capsule for solidification. At lesser amounts of water, the material would be too viscous to flow substantially for effective product manufacture. However, the carbonate based materials can be made in extrusion methods with little water. We have found that as the materials are extruded, the water of hydration tends to associate with the phosphonate component and, depending on conditions, a fraction of the anhydrous sodium carbonate used in the manufacture of the materials. If added water associates with other materials such as sodium hydroxide or sodium silicates, insufficient solidification occurs leaving a product resembling slush, paste or mush like a wet concrete. We have found that the total amount of water present in the solid block detergents of the invention is less than about 11 to 12 wt % water based on the total chemical composition (not including the weight of the container). The preferred solid detergent comprises less than about 1.3, more preferably about 0.9 to 1.3 moles of water per each mole of carbonate. With this in mind for the purpose of this patent application, water of hydration recited in these claims relates primarily to water added to the composition that primarily hydrates and associates with the binder comprising a fraction of the sodium carbonate, the phosphonate and water of hydration. A chemical with water of hydration that is added into the process or products of this invention wherein the hydration remains associated with that chemical (does not dissociate from the chemical and associate with another) is not counted in this description of added water of hydration. Preferred hard dimensionally stable solid detergents will comprise about 5 to 20 wt %, preferably 10 to 15 wt % anhydrous carbonate. The balance of the carbonate comprises carbonate monohydrate. Further, some small amount of sodium carbonate monohydrate can be used in the manufacture of the detergent, however, such water of hydration is used in this calculation.

For the purpose of this application the term "solid block" includes extruded pellet materials having a weight of 50 grams up through 250 grams, an extruded solid with a weight of about 100 grams or greater or a solid block detergent having a mass between about 1 and 10 kilograms.

DETAILED DESCRIPTION OF THE INVENTION

Figure 1:
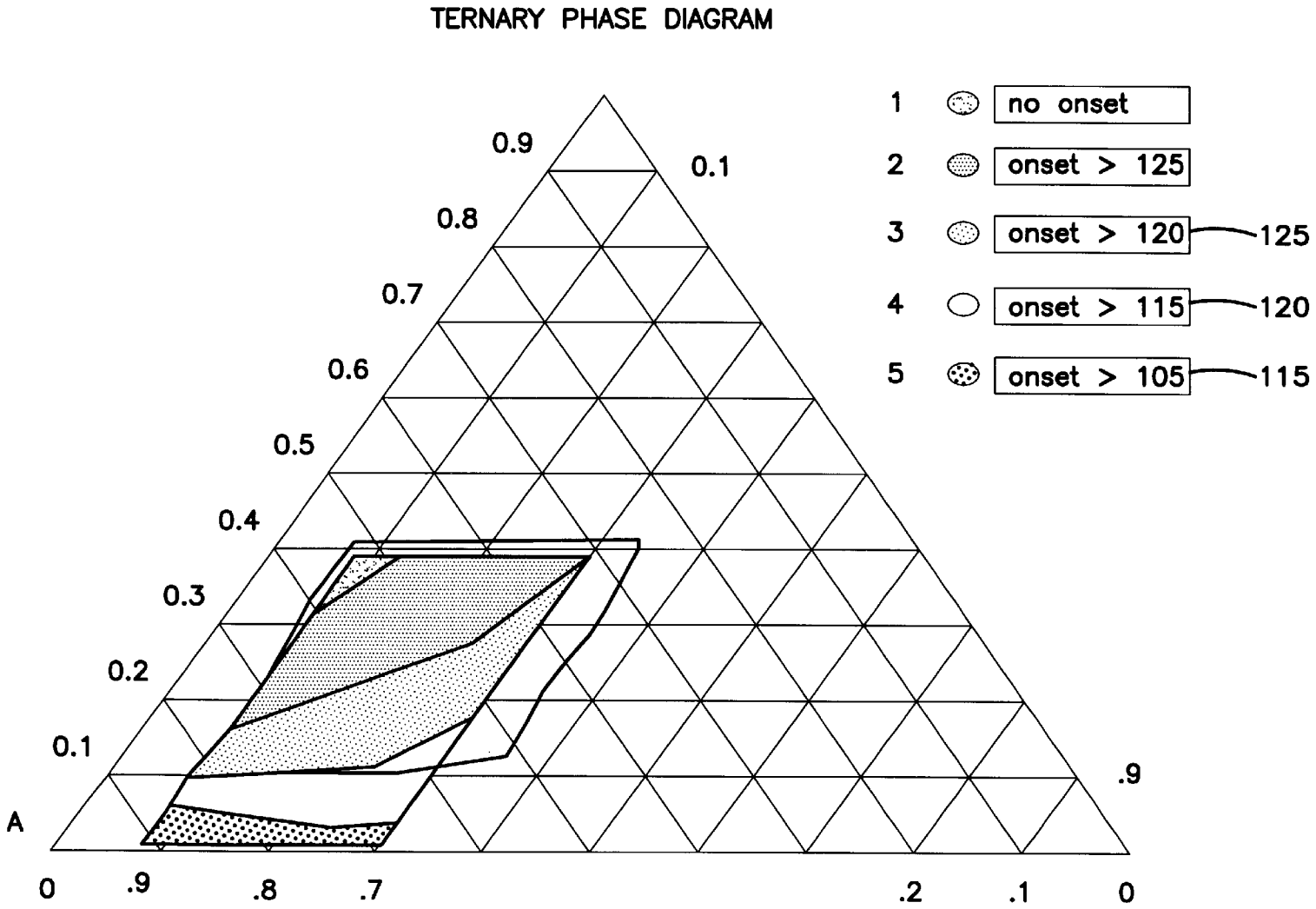
FIG. 1 is a ternary phase diagram showing proportions of sodium carbonate, water and aminotri(methylene phosphonate) sequestrant that permit manufacturing of the solid block detergent containing the E-form hydrate anhydrous carbonate and carbonate hydrate with a decomposition onset temperatures shown in the shaded portions.

The solid block detergents of the invention can comprise a source of alkalinity, a sequestrant and an E-form hydrate binding agent.

Active Ingredients

The present method is suitable for preparing a variety of solid cleaning compositions, as for example, extruded pellet, extruded block, etc., detergent compositions. The cleaning compositions of the invention comprise conventional alkaline carbonate cleaning agent and other active ingredients that will vary according to the type of composition being manufactured.

The essential ingredients are as follows:

Solid Matrix Composition

| Chemical | Percent Range |
|---|---|
| Organo-Phosphonate | 1–30 wt %; preferably 3–15 wt % |
| Water | 5–15 wt %; preferably 5–12 wt % |
| Alkali Metal Carbonate | 25–80 wt %; preferably 30–55 wt % |

As this material solidifies, a single E-form hydrate binder composition forms. This hydrate binder is not a simple hydrate of the carbonate component. We believe the solid detergent comprises a major proportion of carbonate monohydrate, a portion of non-hydrated (substantially anhydrous) alkali metal carbonate and the E-form binder composition comprising a fraction of the carbonate material, an amount of the organophosphonate and water of hydration. The alkaline detergent composition can include an amount of a source of alkalinity that does not interfere with solidification and minor but effective amounts of other ingredients such as surfactant(s), a chelating agent/sequestrant including a phosphonate, polyphosphate, a bleaching agent such as an encapsulated bleach, sodium hypochlorite or hydrogen peroxide, an enzyme such as a lipase, a protease or an amylase, and the like.

Alkaline Sources

The cleaning composition produced according to the invention may include minor but effective amounts of one or more alkaline sources to enhance cleaning of a substrate and improve soil removal performance of the composition. The alkaline matrix is bound into a solid due to the presence of the binder hydrate composition including its water of hydration. The composition comprises about 10–80 wt %, preferably about 15–70 wt % of an alkali metal carbonate source, most preferably about 20–60 wt %. The total alkalinity source can comprise about 5 wt % or less of an alkali metal hydroxide or silicate. A metal carbonate such as sodium or potassium carbonate, bicarbonate, sesquicarbonate, mixtures thereof and the like can be used. Suitable alkali metal hydroxides include, for example, sodium or potassium hydroxide. An alkali metal hydroxide may be added to the composition in the form of solid beads, dissolved in an aqueous solution, or a combination thereof. Alkali metal hydroxides are commercially available as a solid in the form of prilled solids or beads having a mix of particle sizes ranging from about 12–100 U.S. mesh, or as an aqueous solution, as for example, as a 50 wt % and a 73 wt % solution. Examples of useful alkaline sources include a metal silicate such as sodium or potassium silicate (with a $M_2O:SiO_2$ ratio of 1:2.4 to 5:1, M representing an alkali metal) or metasilicate; a metal borate such as sodium or potassium borate, and the like; ethanolamines and amines; and other like alkaline sources.

Cleaning Agents

The composition can comprises at least one cleaning agent which is preferably a surfactant or surfactant system. A variety of surfactants can be used in a cleaning composition, including anionic, nonionic, cationic, and zwitterionic surfactants, which are commercially available from a number of sources. Anionic and nonionic agents are preferred. For a discussion of surfactants, see Kirk-Othmer, *Encyclopedia of Chemical Technology,* Third Edition, volume 8, pages 900–912. Preferably, the cleaning composition comprises a cleaning agent in an amount effective to provide a desired level of cleaning, preferably about 0–20 wt %, more preferably about 1.5–15 wt %.

Anionic surfactants useful in the present cleaning compositions, include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, and fatty alcohol sulfates.

Nonionic surfactants useful in cleaning compositions, include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds. Silicone surfactants such as the ABIL B8852 can also be used.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$–$C_{18}$) dimethylbenzyl ammonium chloride, n-tetradecyldimethylbenzylammonium chloride monohydrate, a naphthylene-substituted quaternary ammonium chloride such as dimethyl-1-naphthylmethylammonium chloride, and the like; and other like cationic surfactants.

Other Additives

Solid cleaning compositions made according to the invention may further include conventional additives such as a chelating/sequestering agent, bleaching agent, alkaline source, secondary hardening agent or solubility modifier, detergent filler, defoamer, anti-redeposition agent, a threshold agent or system, aesthetic enhancing agent (i.e., dye, perfume), and the like. Adjuvants and other additive ingredients will vary according to the type of composition being manufactured. The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. Preferably, a cleaning composition includes about 0.1–70 wt %, preferably from about 5–60 wt %, of a chelating/sequestering agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$; aminotri(methylenephosphonic acid) $N[CH_2PO(OH)_2]_3$; aminotri(methylenephosphonate), sodium salt

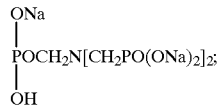

2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene)triamine(pentamethylenephosphonic acid) $(HO_2)POCH_2N[(CH_2)_6N[CH_2PO(OH)_2]_2]_2$; and phosphorus acid $H_3PO_3$. A preferred phosphonate combination is ATMP and DTPMP. A neutralized or alkaline phosphonate, or a combination of the phosphonate with an alkali source prior to being added into the mixture such that there is little or no heat or gas generated by a neutralization reaction when the phosphonate is added is preferred.

Polymeric polycarboxylates suitable for use as cleaning agents have pendant carboxylate ($—CO_2^-$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, *Encyclopedia of Chemical Technology,* Third Edition, volume 5, pages 339–366 and volume 23, pages 319–320, the disclosure of which is incorporated by reference herein.

Bleaching agents for use in a cleaning compositions for lightening or whitening a substrate, include bleaching compounds capable of liberating an active halogen species, such as $Cl_2$, $Br_2$, $—OCl^-$ and/or $—OBr^-$, under conditions typically encountered during the cleansing process. Suitable bleaching agents for use in the present cleaning compositions include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, preferably about 0.1–10 wt %, preferably about 1–6 wt %.

Detergent Builders or Fillers

A cleaning composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, $C_1$–$C_{10}$ alkylene glycols such as propylene glycol, and the like. Preferably, a detergent filler is included in an amount of about 1–20 wt %, preferably about 3–15 wt %.

Defoaming Agents

A minor but effective amount of a defoaming agent for reducing the stability of foam may also be included in the present cleaning compositions. Preferably, the cleaning composition includes about 0.0001–5 wt % of a defoaming agent, referably about 0.01–3 wt %.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-redeposition Agents

A cleaning composition may also include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. A cleaning composition may include about 0.5–10 wt %, preferably about 1–5 wt %, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Aqueous Medium

The ingredients may optionally be processed in a minor but effective amount of an aqueous medium such as water to achieve a homogenous mixture, to aid in the solidification, to provide an effective level of viscosity for processing the mixture, and to provide the processed composition with the desired amount of firmness and cohesion during discharge and upon hardening. The mixture during processing typically comprises about 0.2–12 wt % of an aqueous medium, preferably about 0.5–10 wt %.

Processing of the Composition

The invention provides a method of processing a solid cleaning composition. According to the invention, a cleaning agent and optional other ingredients are mixed with an effective solidifying amount of ingredients in an aqueous medium. A minimal amount of heat may be applied from an external source to facilitate processing of the mixture.

A mixing system provides for continuous mixing of the ingredients at high shear to form a substantially homogeneous liquid or semi-solid mixture in which the ingredients are distributed throughout its mass. Preferably, the mixing system includes means for mixing the ingredients to provide shear effective for maintaining the mixture at a flowable consistency, with a viscosity during processing of about 1,000–1,000,000 cP, preferably about 50,000–200,000 cP. The mixing system is preferably a continuous flow mixer or more preferably, a single or twin screw extruder apparatus, with a twin-screw extruder being highly preferred.

The mixture is typically processed at a temperature to maintain the physical and chemical stability of the ingredients, preferably at ambient temperatures of about 20–80° C., more preferably about 25–55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the cleaning agent, the aqueous medium, and additional ingredients such as a second cleaning agent, a detergent adjuvant or other additive, a secondary hardening agent, and the like. One or more premixes may be added to the mixture.

The ingredients are mixed to form a substantially homogeneous consistency wherein the ingredients are distributed substantially evenly throughout the mass. The mixture is then discharged from the mixing system through a die or other shaping means. The profiled extrudate then can be divided into useful sizes with a controlled mass. Preferably, the extruded solid is packaged in film. The temperature of the mixture when discharged from the mixing system is preferably sufficiently low to enable the mixture to be cast or extruded directly into a packaging system without first cooling the mixture. The time between extrusion discharge and packaging may be adjusted to allow the hardening of the detergent block for better handling during further processing and packaging. Preferably, the mixture at the point of discharge is about 20–90° C., preferably about 25–55° C. The composition is then allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20–90° C.

When processing of the ingredients is completed, the mixture may be discharged from the mixer through a discharge die. The composition eventually hardens due to the chemical reaction of the ingredients forming the E-form hydrate binder. The solidification process may last from a few minutes to about six hours, depending, for example, on the size of the cast or extruded composition, the ingredients of the composition, the temperature of the composition, and other like factors. Preferably, the cast or extruded composition "sets up" or begins to hardens to a solid form within about 1 minute to about 3 hours, preferably about 1 minute to about 2 hours, preferably about 1 minute to about 20 minutes.

Packaging System

The packaging receptacle or container may be rigid or flexible, and composed of any material suitable for containing the compositions produced according to the invention, as for example glass, metal, plastic film or sheet, cardboard, cardboard composites, paper, and the like.

Advantageously, since the composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions.

Preferred packaging used to contain the compositions is manufactured from a flexible, easy opening film material.

Dispensing of the Processed Compositions

Figure 11:
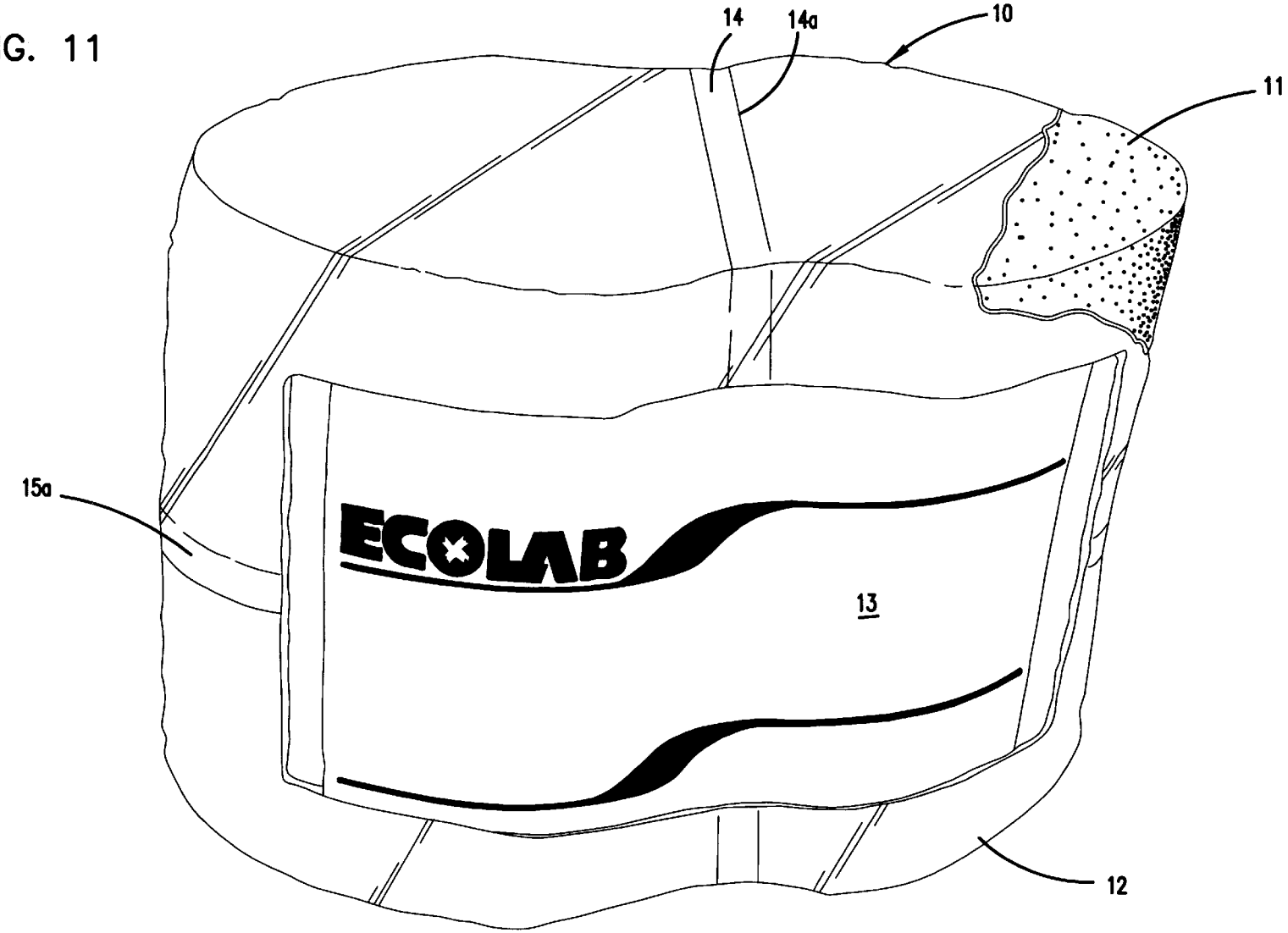
FIG. 11 is an isometric drawing of the wrapped solid detergent.

The cleaning composition made according to the present invention is dispensed from a spray-type dispenser such as that disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use. The preferred product shape is shown in FIG. 11. When used, the product is removed from the package (e.g.) film and is inserted into the dispenser. The spray of water can be made by a nozzle in a shape that conforms to the solid detergent shape. The dispenser enclosure can also closely fit the detergent shape in a dispensing system that prevents the introduction and dispensing of an incorrect detergent.

DETAILED DISCUSSION OF THE DRAWINGS

FIG. 1 is a ternary phase diagram showing a solid block detergent composition comprising sodium carbonate, aminotri(methylenephosphonate) and water. In the region defined by ABCD, various areas show proportions of materials that develop a hydrate material that decomposes at certain hydrate decomposition onset temperatures as shown. Regions 2 and 3 are characteristic of preferred solid detergent compositions containing the E-form hydrate binder.

Figure 2:
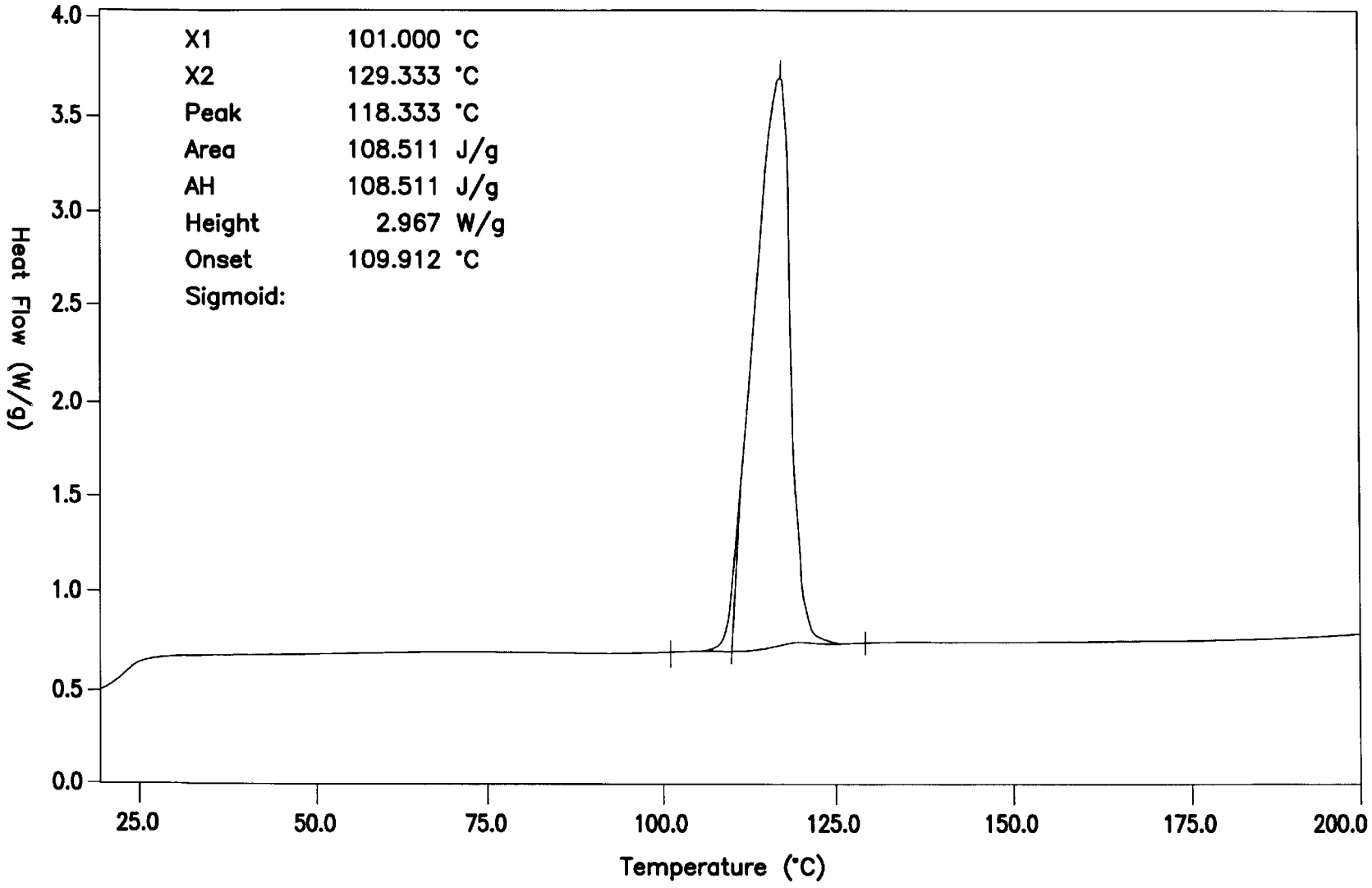
FIGS. 2 through 10 are differential scanning calorimeter (DSC) scans of data relating to a sodium carbonate monohydrate; a solid composition of a sodium carbonate and an organophosphonate and a solid detergent comprising a mass of anhydrous sodium carbonate bound into a block which data demonstrates the production of a novel E-form binding agent comprising a hydrated composition of a sodium carbonate and an organophosphonate. These Figures demonstrate the novel hydration state and E-form structure of the invention.

FIG. 2 is a DSC scan of a sample of ash and water mixed at the monohydrate proportions in a laboratory prepared sample and allowed to age over 24 hours at 37.8° C. This material has a hydrate decomposition onset of about 110° C. which is characteristic or typical for sodium carbonate monohydrate. All DSC curves included with this letter were run on a Perkin Elmer Model DSC-7.

Figure 3:
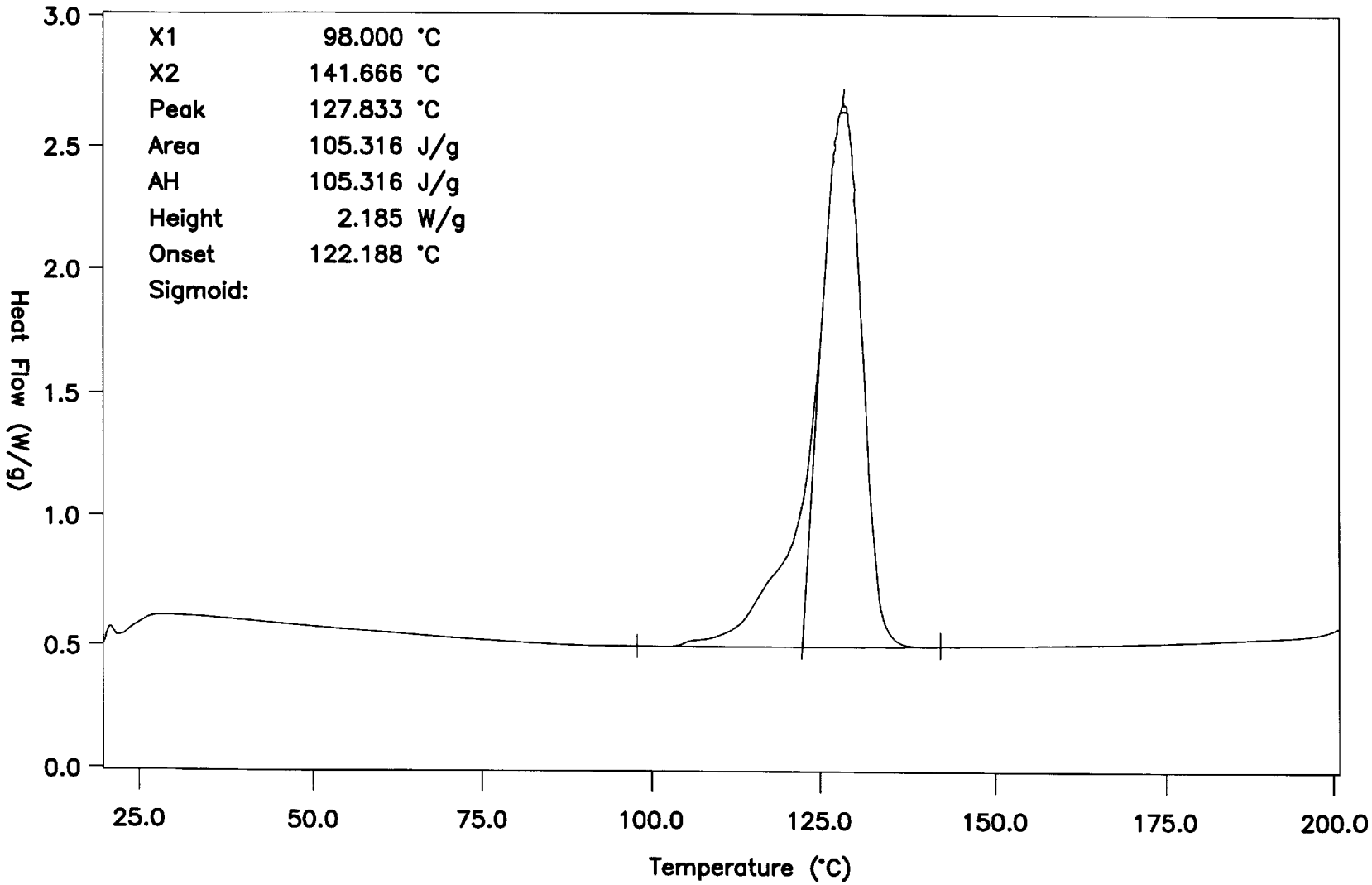

FIG. 3 is a DSC curve for a mixture of sodium carbonate (ash), ATMP and water at a ratio of 50 to 3.35 to 11.4, respectively. The sample is again mixed in the laboratory and allowed to age in a 37.8° C. oven for a 24 hour period. The onset temperature of the resulting solid has shifted to 122° C. which we believe is characteristic of the E-form hydrate binding agent comprising ATMP, hydrated and non-hydrated ash and water. The change in onset temperature results from the association of phosphonate ash hydrate and water in the E-form binding agent.

Figure 4:
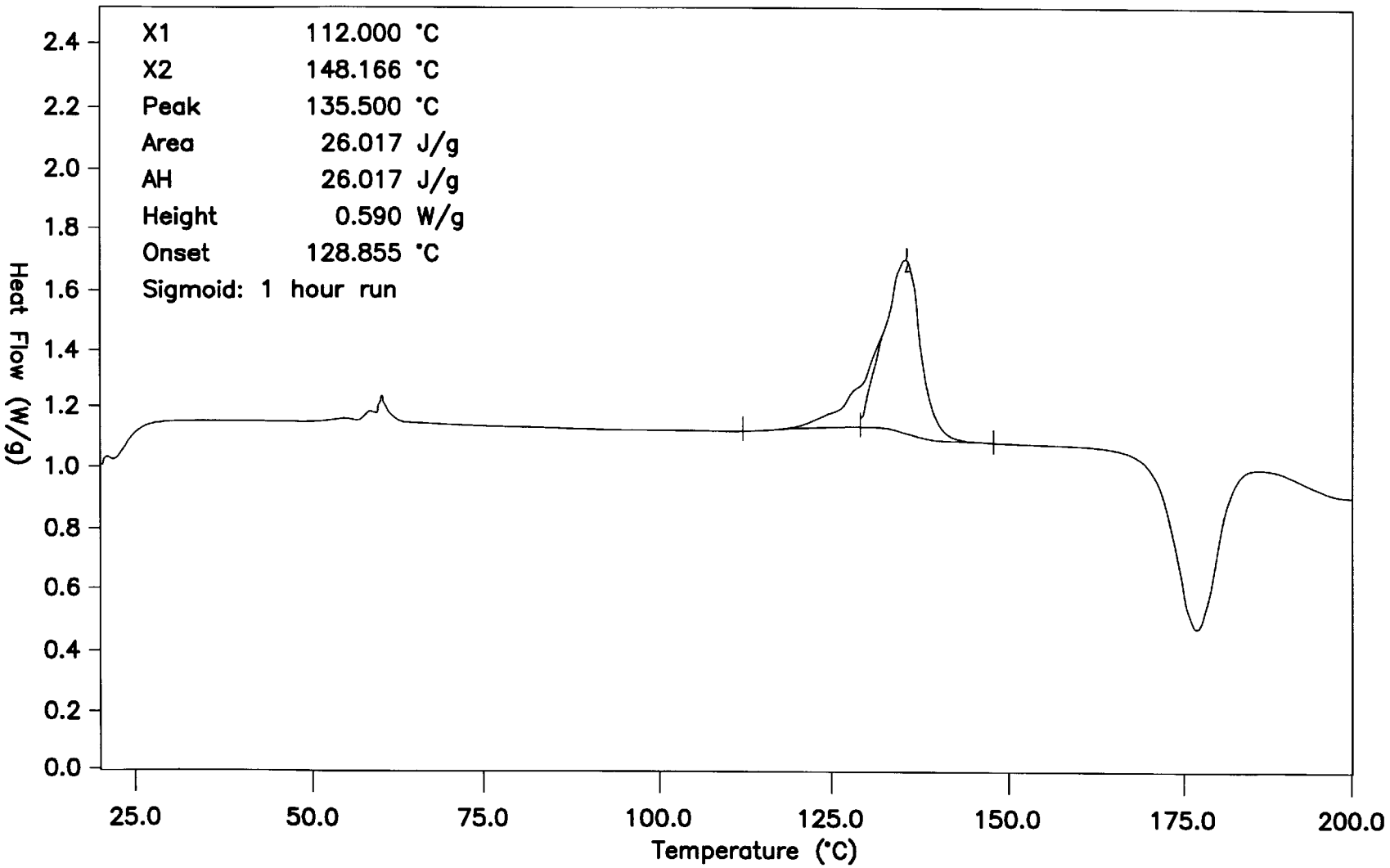

FIG. 4 is a DSC curve of an extruded product. The material of the experiment had the following formula:

| Raw Material Description | Percent (%) |
|---|---|
| Nonionic | 7.000 |
| Soft Water | 9.413 |
| Nonionic Surfactant premix | 1.572 |
| Amino trimethylene phosphonate | 6.700 |
| Low Density $Na_2CO_3$ | 47.065 |
| STPP, large granular | 28.250 |

The product was formulated as follows: 2% of the nonionic was premixed with the large granular sodium triolyphosphate (STPP), the surfactant premix D and the aminotri (methylene phosphonate) (ATMP) in a first powder feeder. The purpose of this premix was to hold a fine, spray-dried ATMP NSD together with the large granular STPP to prevent segregation during processing. The anhydrous sodium carbonate (ash) is fed with a second powder feeder and the water and remaining surfactant were both pumped by separate pumps to a Teledyne processor equipped with an extrusion screw sections. The production rate for this experiment was 30 lbs/minute and a 1200 lb. batch of product was produced. In the DSC curve in FIG. 4, the spike resembles very closely the hydration spike of the E-form complex seen in FIG. 3. The decomposition onset temperature is shifted to 128° C. unlike the monohydrate of ash seen in FIG. 2 at about 110° C.

Figure 5:
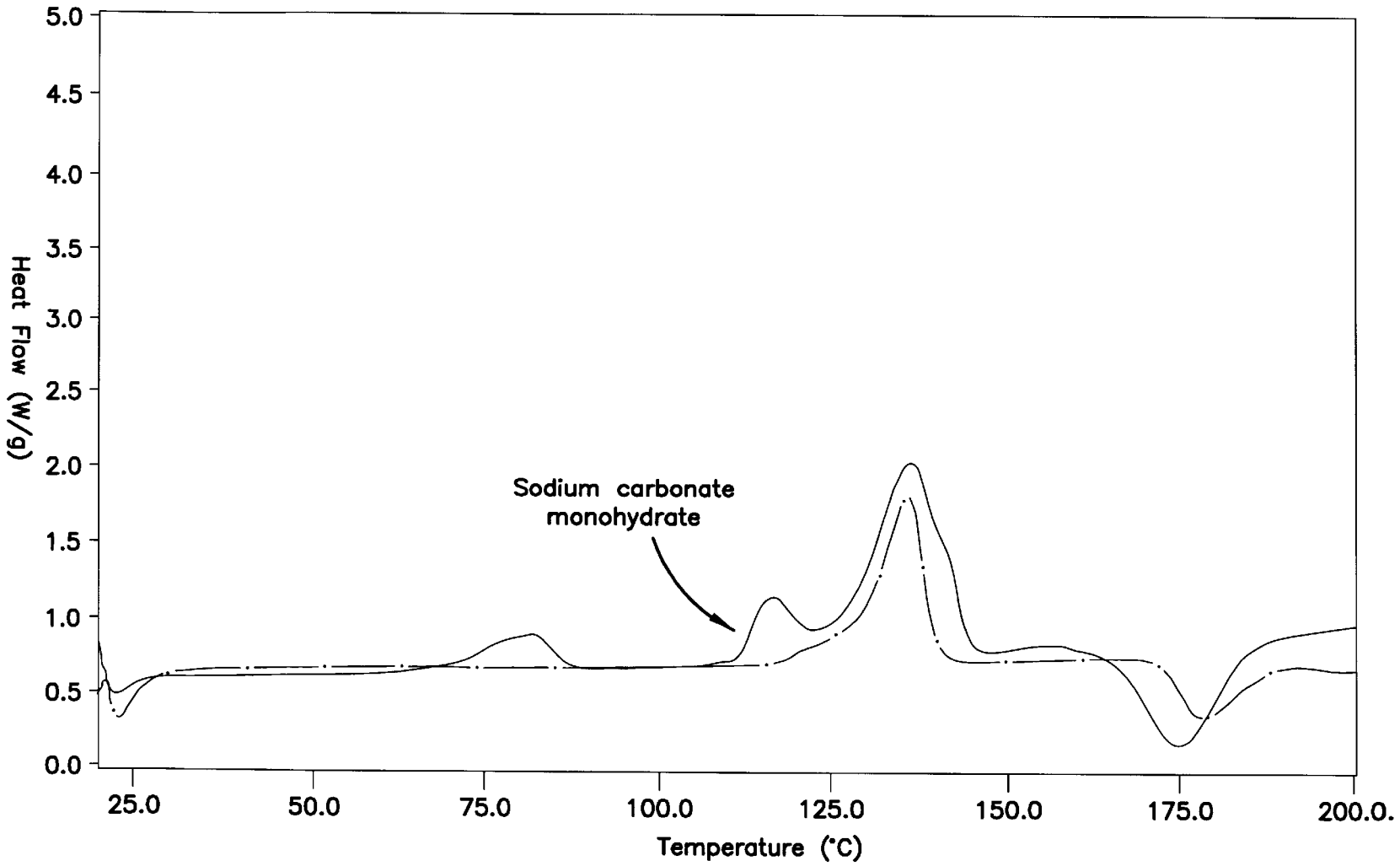

FIG. 5 demonstrates the difference between a sodium carbonate monohydrate composition and the sodium carbonate composition formed into a solid using the E-form hydrate material in the invention. FIG. 5 contains two DSC curves, a first curve comprising a line having an intermittent dot, and a second curve comprising a solid line. The curve having an included dot represents the solid detergent bound into a solid material using the E-form hydrate. The solid line represents a material formed by exposing the solid detergent composition of the invention containing the E-form hydrate binding agent to the ambient humid atmosphere. The solid detergent of the invention combines with humidity of the ambient atmosphere and forms sodium carbonate monohydrate which is represented by the appearance of a secondary peak at a characteristic monohydrate temperature to the left of the main E-form hydrate peak. A third smaller peak to the left of both the E-form hydrate and a monohydrate peak is shown. This peak is attributed to the formation of a seven mole hydrate during the combination of humidity of the ambient atmosphere with the anhydrous sodium carbonate in the solid block detergent of the invention.

Figure 6:
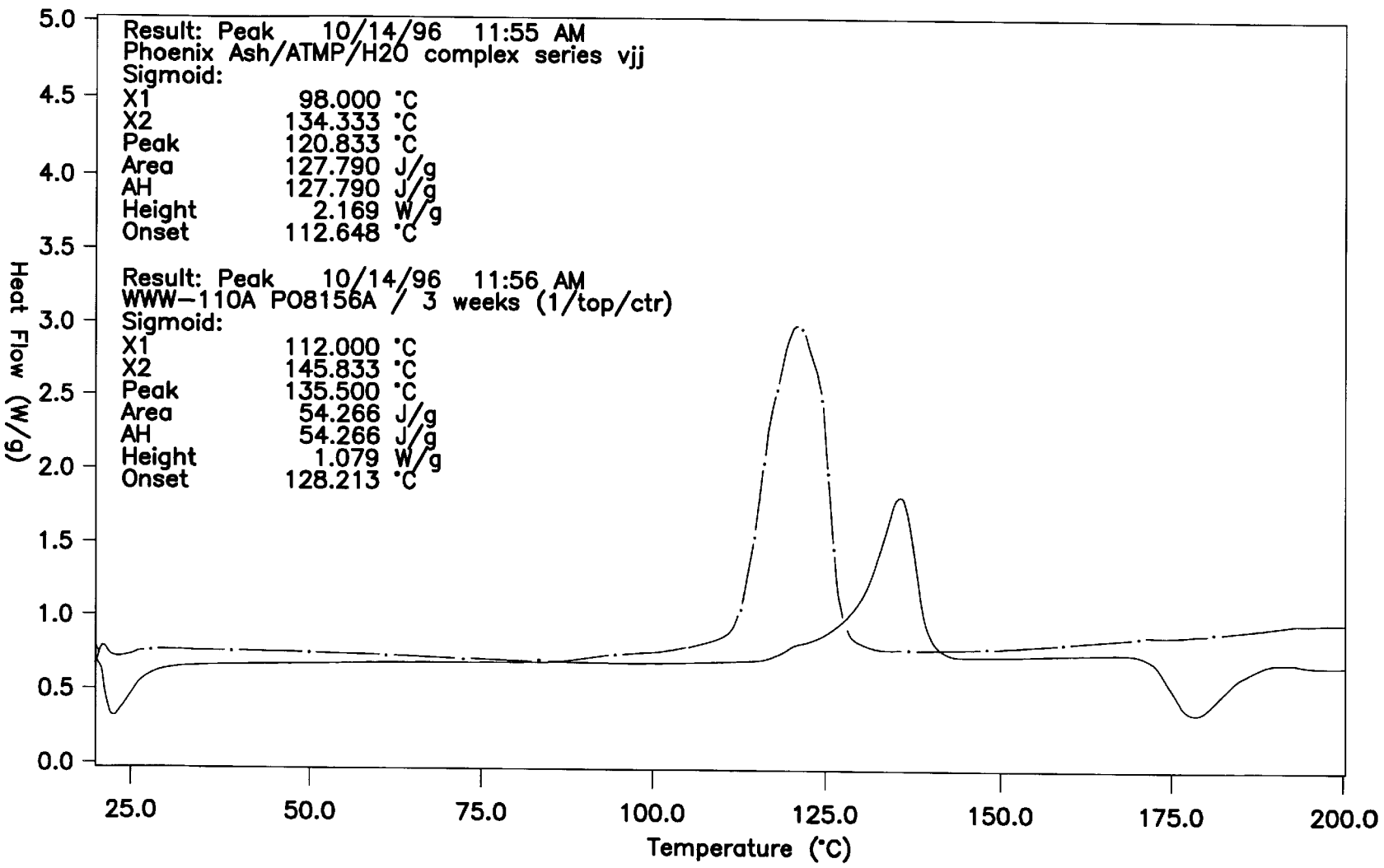
Figure 7:
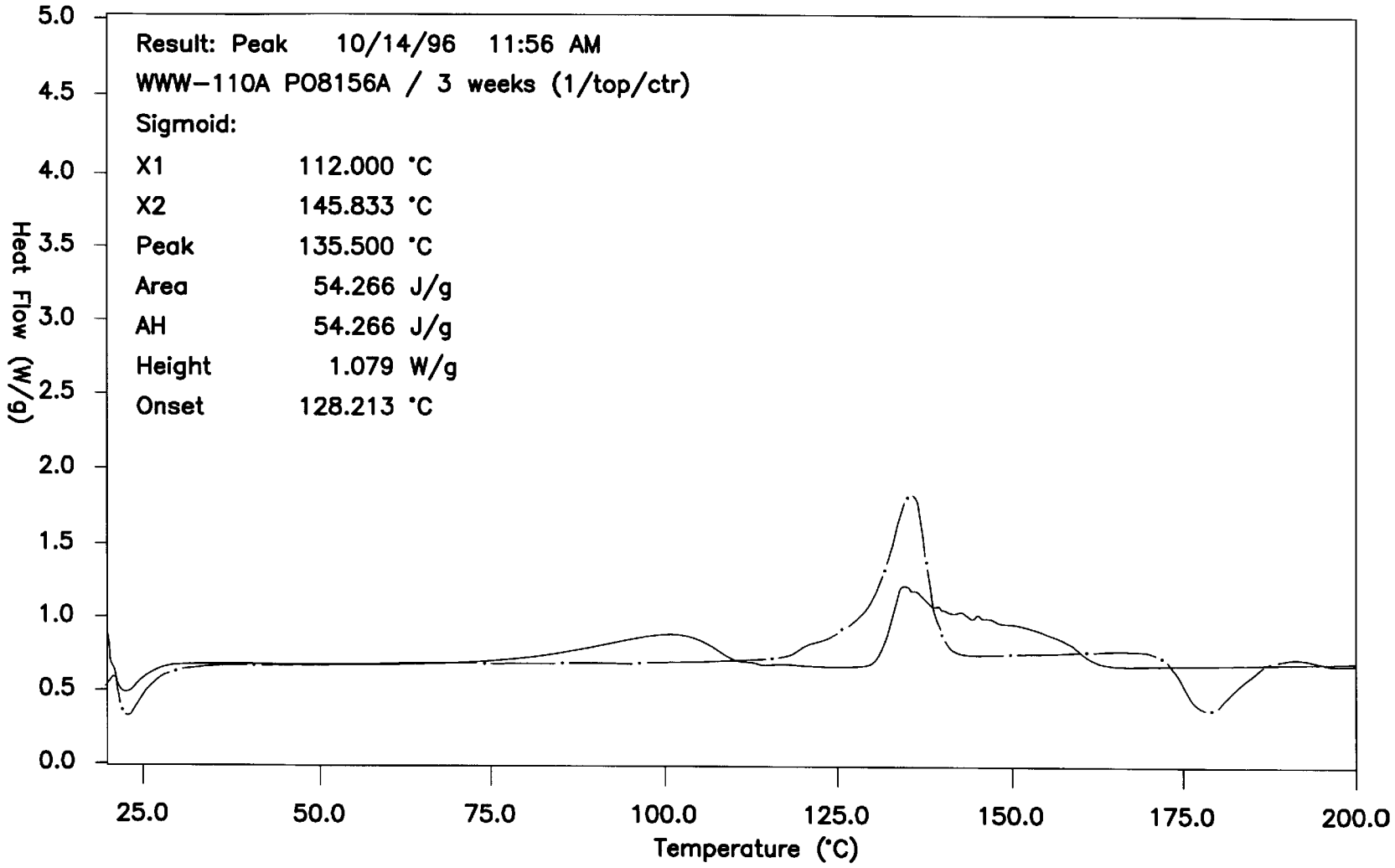
Figure 8:
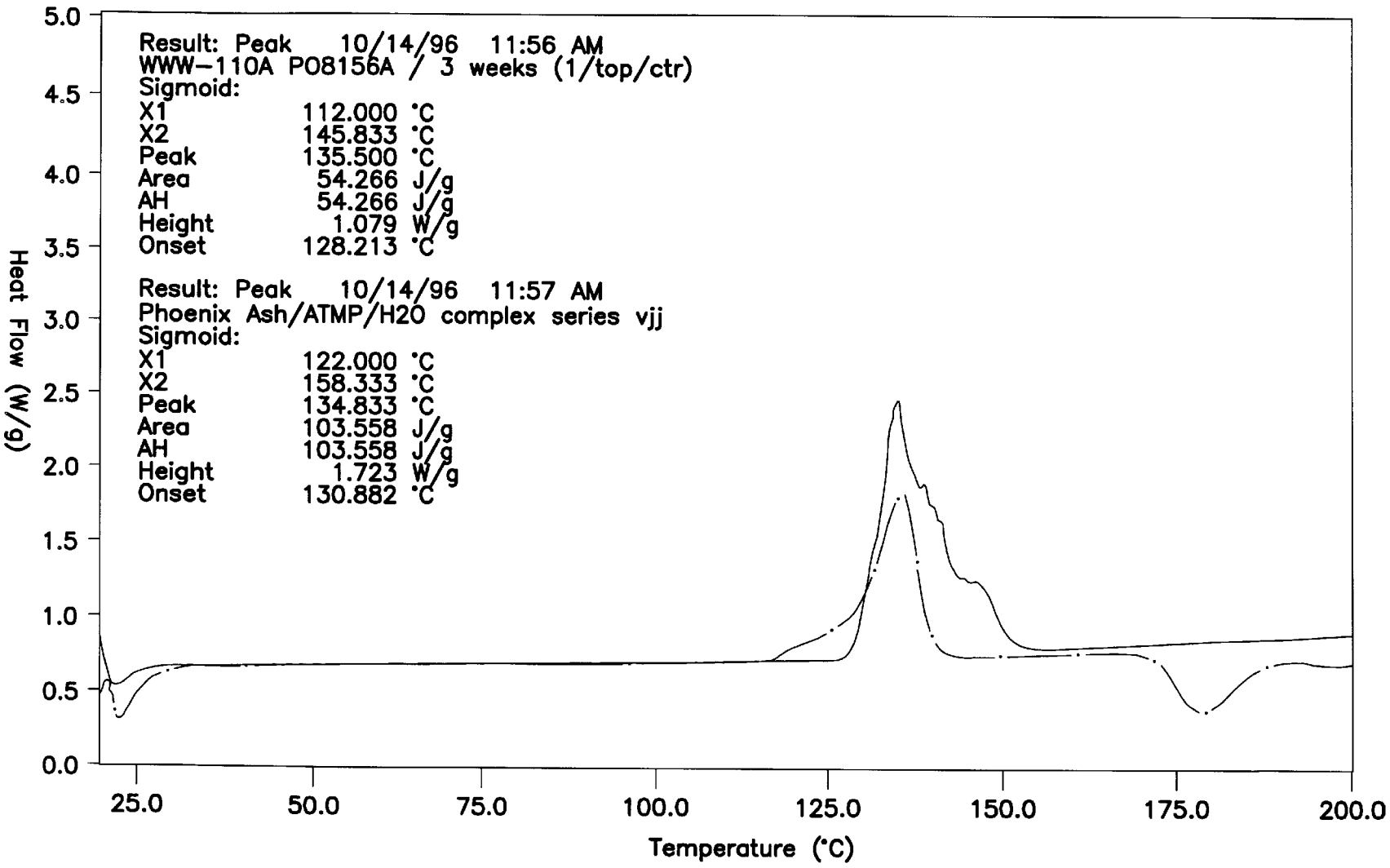
Figure 9:
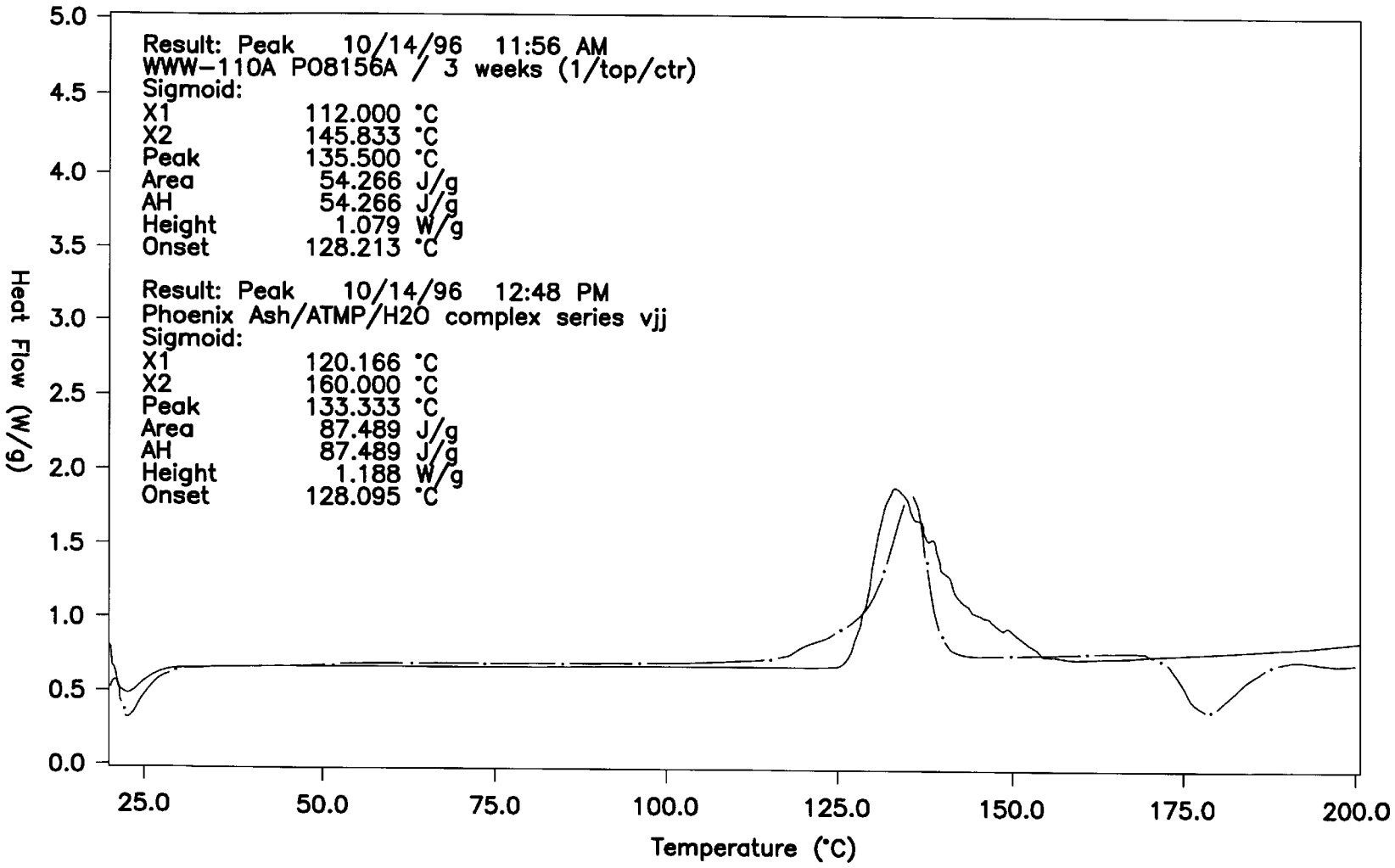
Figure 10:
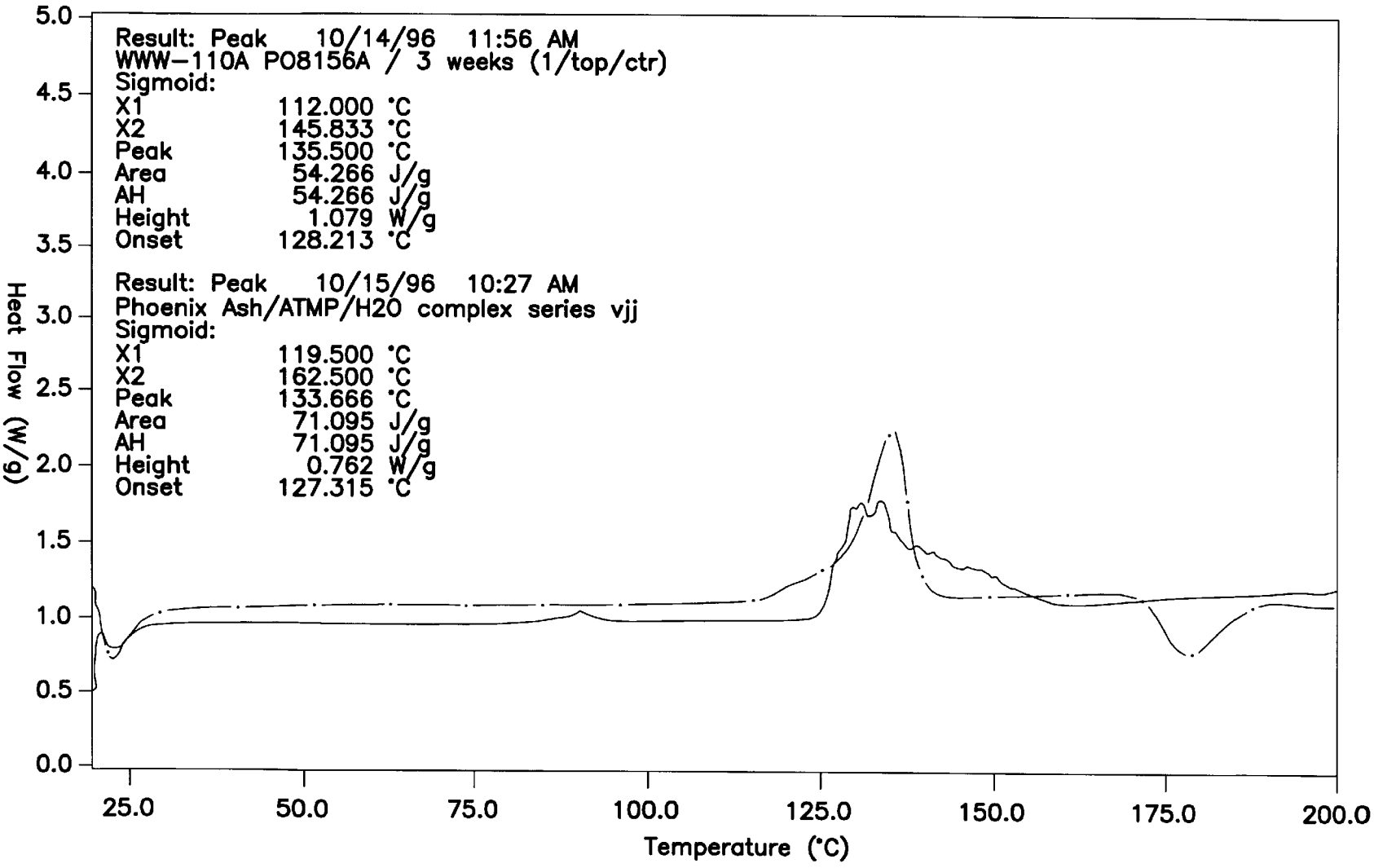

FIG. 6 displays a comparison similar to that shown in FIGS. 2 and 3. In FIG. 6 two curves are shown. The solid line represents a solid block detergent of the invention containing the E-form hydrate. The broken line displays the thermal characteristics of ash hydrate alone. The difference in the temperature peaks shows that the ash monohydrate formed under the conditions of the experiment is substantially different than the E-form hydrate material of the invention.

FIGS. 7 through 10 compare an ash aminotri(methylene phosphonate) complex formed in varying molar ratios with the cast solid detergent material of the invention. This series of DSC curves show that as the ratio of ash to ATMP nears about 5 to 1, the curves most nearly represent the E-form hydrate material of the invention. Based on these differential scanning calorimetry scans, we believe that the E-form hydrate material has a mole ratio of ash to ATMP of about 5:1, however, some proportion of the E-form hydrate material forms at ratios that range from about 3:1 to about 7:1 ash:ATMP.

FIG. 11 is a drawing of a preferred embodiment of the packaged solid block detergent of the invention. The detergent has a unique pinch waist elliptical profile. This profile ensures that this block with its particular profile can fit only spray on dispensers that have a correspondingly shaped location for the solid block detergent. We are unaware of any solid block detergent having this shape in the market place. The shape of the solid block ensures that no unsuitable substitute for this material can easily be placed into the dispenser for use in a warewashing machine. In FIG. 1 the overall product 10 is shown having a cast solid block 11 (revealed by the removal of packaging 12). The packaging includes a label 13. The film wrapping can easily be removed using a tear line 15 or 15*a* or fracture line 14 or 14*a* incorporated in the wrapping.

Figure 12:
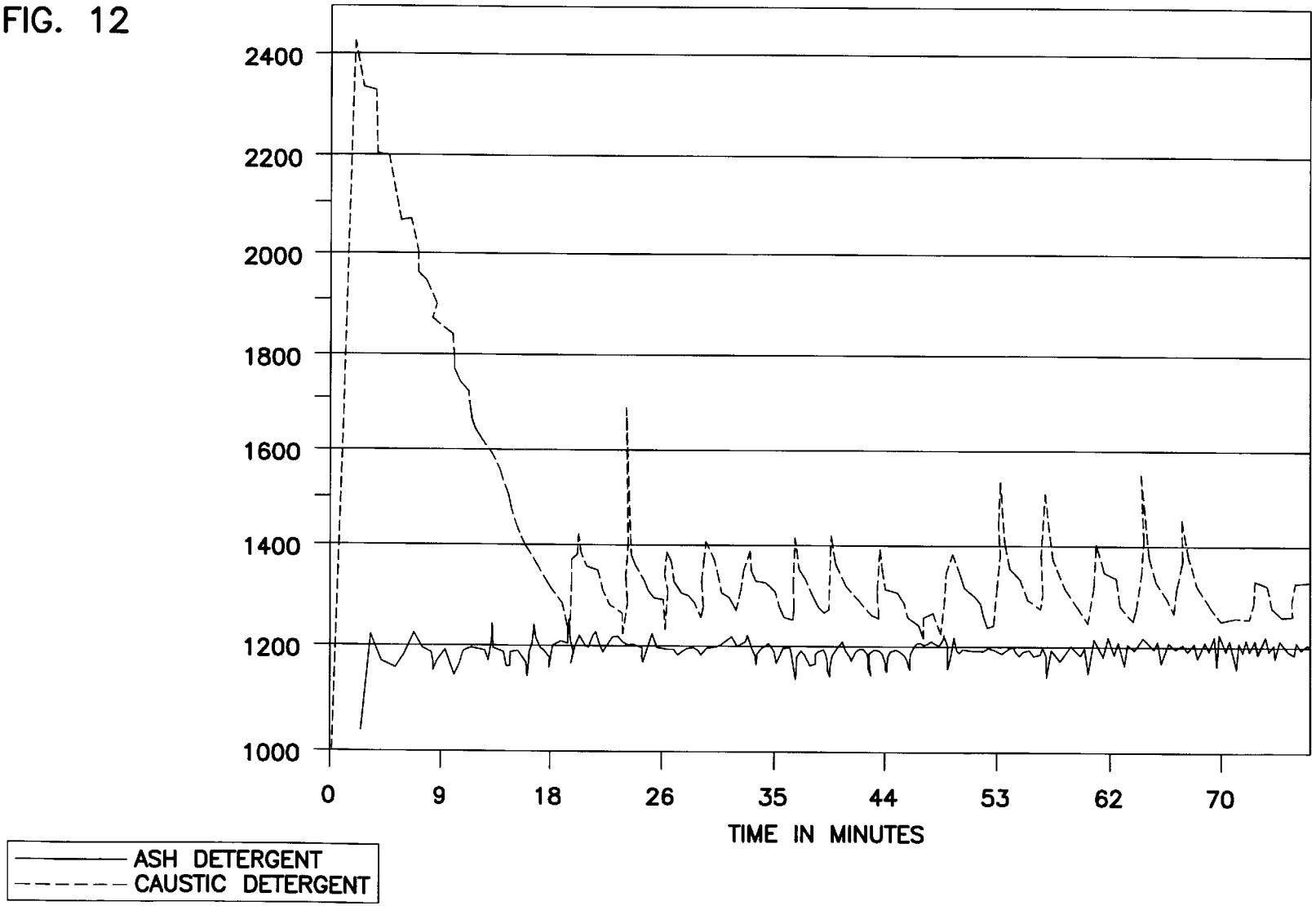
FIG. 12 is a graph representative of improved dispensing characteristics of the E-form containing solid detergent when compared to a caustic solid.

We have also conducted dispensing experiments with formulas substantially similar to those in formulas 1 and 2. We have surprisingly found that in conductivity based dispenser operation that control over dispensing of sodium carbonate based detergents can be significantly better than control over caustic based detergents. We have found in typical dispensing conditions, that caustic based detergents can often overshoot targeted levels to a degree greater than ash based detergents. We have also found that in sodium carbonate based detergents, after a first or second cycle, the amount of detergent dispensed in each cycle does not vary from a target concentration, e.g. about 800–1200 ppm active ingredient by more than about 2%. These data are shown in FIG. 12. In FIG. 12 the vertical axis is concentration in ppm and the horizontal axis is time. Often, in the initial dispensing cycles using a new solid block ash based detergent, the first one or two cycles can have 50–80% of the desired amount of active ingredients. However, after these initial cycles, control over the amount of active ingredient (sodium carbonate) in the wash water is significantly improved.

In sharp contrast, using caustic based alkaline detergents, even in initial cycles, overshoot of the amount of caustic desired can often be as much as 100% or more. Even during typical use cycles, overshoot can vary between less than about 0.1% to about 20%. While these overshoot values typically do not harm cleaning capacity, such an overshoot can under certain circumstances be somewhat wasteful detergent material.

The above specification provides a basis for understanding the broad meets and bounds of the invention. The following examples and test data provide an understanding of certain specific embodiments of the invention and contain a best mode. The invention will be further described by reference to the following detailed examples. These examples are not meant to limit the scope of the invention that has been set forth in the foregoing description. Variation within the concepts of the invention are apparent to those skilled in the art.

EXAMPLE 1

The experiment was run to determine the level of water needed to extrude a sodium carbonate product. The product of this example is a presoak but applies equally to a warewash detergent product. A liquid premix was made using water, nonyl phenol ethoxylate with 9.5 moles EO (NPE 9.5), a Direct Blue 86 dye, a fragrance and a Silicone Antifoam 544. These were mixed in a jacketed mix vessel equipped with a marine prop agitator. The temperature of this premix was held between 85–90° F. to prevent gelling. The rest of the ingredients for this experiment were sodium tripolyphosphate, sodium carbonate, and LAS 90% flake which were all fed by separate powder feeders. These materials were all fed into a Teledyne 2" paste processor at the percentages shown in Table 2. Production rates for this experiment varied between 20 and 18 lbs/minute. The experiment was divided into five different sections, each section had a different liquid premix feed rate, which reduced the amount of water in the formula. The percent of these reductions can be seen on Table 2. Product discharged the Teledyne through an elbow and a 1½" diameter sanitary pipe. Included in Table 2 are the ratios of water to ash for each of the experiments. Also on this table are the results of the experiment, the higher levels of water to ash molar ratios (about 1.8–1.5) produced severe cracking and swelling. Only when levels of water approached 1.3 or less did we see no cracking or swelling of the blocks. Best results were seen at a 1.25 water to ash molar ratio. This shows an example that an extruded ash based product can be made but the water level has to be maintained at lower levels in order to prevent severe cracking or swelling.

EXAMPLE 2

The next example is an example of a warewashing detergent produced in a 5" Teledyne paste processor. The premix was made of Surfactant Premix 3 (which is 84% nonionic a pluronic type nonionic and 16% of a mixed mono- and di (about $C_{16}$) alkyl phosphate ester with large granular sodium tripolyphosphate and spray dried ATMP (aminotri(methylene phosphonic acid). The ATMP sprayed dried was neutralized prior to spray drying to a pH of 12–13. The purpose of this premix is to make a uniform material to be fed to the Teledyne without segregation occurring. The formula for this experiment is as follows:

TABLE 1

| Raw Material Description | Percent (%) |
|---|---|
| Soft Water | 10.972 |
| Nonionic | 3.500 |
| Dense Ash, $Na_2CO_3$ | 49.376 |
| Tripoly, large granular | 30.000 |
| Surfactant | 1.572 |
| Amino tris (methylene phosphonic acid) | 4.500 |
| Dye | 0.080 |

The dye, which is Direct Blue 86 was premixed in the mix tank with the soft water. Production rate for this experiment was 30 lbs/minute and a 350 lb. batch was made. The molar ratio of water to ash was 1.3 for this experiment. The Teledyne process extruder was equipped with a 5½" round elbow and straight sanitary pipe fitting at the discharge. Blocks were cut into approximately 3 lb. blocks. The Teledyne was run at approximately 300 rpm and the discharge pressure was about 20 psi. Water temperature for this experiment was held at 15° C. (59° F.), surfactant temperature was 26° C. (80° F.), and the average block discharge temperature was 46° C. (114° F.). Production ran well with blocks hardening up 15–20 minutes after discharging out of the Teledyne, no cracking or swelling was noted for this experiment.

EXAMPLE 3

Laboratory samples were made up to determine the phase diagram of ATMP, sodium carbonate and water. The spray dried neutralized version of ATMP used in Example 2 is the same material that is used in this experiment. Anhydrous light density carbonate (FMC grade 100) and water were used for the other ingredients. These mixtures were allowed to react and equilibrate in a 38° C. (100° F.) oven overnight. The samples were then analyzed by DSC to determine the onset of the hydration decomposition spike for each sample. The results of these experiments was a phase diagram which can be seen in FIG. 1. A shift in the onset of the hydrate decomposition temperature as ATMP is added to the mixtures seen. The normal monohydrated ash spike is seen at very low levels of ATMP. But with increased amounts of ATMP, a region of larger proportions of a more stable E-form hydrate binding agent which we believe to be a complex of ATMP, water and ash, is found. We also believe that this is a composition which is responsible for much improved hardens of the blocks with products containing ATMP. The blocks containing ATMP are less likely to crack than blocks not containing ATMP. Also blocks containing ATMP can contain a higher level of water than blocks that do not contain the ATMP.

EXAMPLE 4

For this experiment we ran the same experiment as Example 3 except that Bayhibit AM (which is 2-phosphonobutane-1,2,4-tricarboxylic acid) was substituted for the ATMP. The material used was neutralized to a pH of 12–13 and dried. Mixtures of this material, ash and water, were then prepared and allowed to be equilibrated overnight in a 100° F. oven. Samples were then analyzed by DSE for the onset of hydration decomposition temperature. This system gave comparable results with a higher onset of hydration decomposition.

At this time we believe that an improved extruded ash based solid can be obtained by adding a phosphonate to the formula. We believe that the phosphonates, ash, water E-form complex is the main method of solidification for these systems. This is a superior solidification system to extant monohydrate of ash since it provides a much harder, stronger solid and less prone to cracking and swelling.

TABLE 2

| | PATENT EXAMPLES OF A PRESOAK PRODUCT | | | | |
|---|---|---|---|---|---|
| | PERCENT | PERCENT | PERCENT | PERCENT | PERCENT |
| | LIQUID PREMIX FIRST LIQUID PORT | | | | |
| WATER SOFT | 12.1 | 11.2 | 10.1 | 8.9 | 7.6 |
| NonylPhenol Ethoxylate (9.5 mole) | 9.4 | 8.7 | 7.8 | 6.9 | 5.9 |

TABLE 2-continued

| | PATENT EXAMPLES OF A PRESOAK PRODUCT | | | | |
|---|---|---|---|---|---|
| | PERCENT | PERCENT | PERCENT | PERCENT | PERCENT |
| DIRECT BLUE 86 | 0.1 | 0.1 | 0.1 | 0.1 | 0.1 |
| FRAGRANCE | 0.3 | 0.3 | 0.2 | 0.2 | 0.2 |
| SILICONE ANTIFOAM 544 | 0.1 | 0.1 | 0.1 | 0.1 | 0.1 |
| | POWDERS FIRST POWDER PORT | | | | |
| SODIUM TRIPOLY | 33.5 | 34.2 | 35.1 | 36.0 | 37.0 |
| SODIUM CARBONATE | 39.0 | 39.8 | 40.8 | 41.9 | 43.1 |
| LAS 90% FLAKE | 5.5 | 5.7 | 5.8 | 6.0 | 6.1 |
| TOTAL | 100.0 | 100.0 | 100.0 | 100.0 | 100.0 |
| MOLES OF CARBONATE | 0.0037 | 0.0038 | 0.0039 | 0.0040 | 0.0041 |
| MOLES OF WATER | 0.0067 | 0.0062 | 0.0056 | 0.0049 | 0.0042 |
| MOLE RATIO WATER TO ASH | 1.8 | 1.66 | 1.46 | 1.25 | 1.04 |
| RESULTS | BAD/ SWELLED | BAD/ SWELLED | MARGINAL/ SLIGHT SWELLING AND CRACKING | BEST/ NO CRACKING OR SWELLING | GOOD/WITH SOME DRY SPOTS/NO CRACKING OR SWELLING |

EXAMPLE 5

A sodium carbonate based detergent (formula 1) was tested vs. a NaOH based detergent (formula 2). The compositions of these two formulas are listed in Table 3.

TABLE 3

| | | Formula 1 | Formula 2 |
|---|---|---|---|
| Alkalinity sources | NaOH | — | 45.6 |
| | $NaCO_3$ | 50.5 | 6.1 |
| Chelating (water conditioning) agents | Sodium Tripolyphosphate | 30 | 30 |
| | Sodium Aminotri(methylene phosphonate) | 6.7 | — |
| | Polyacrylic Acid | — | 1.6 |
| Nonionic/ Defoamers | (EO) (PO) materials | 1.5 | 1.4 |
| Detergency enhancing surfactants | Nonionic | 1.8 | — |
| (Others) | Ash - 11% water S.P. >> [water] | Inerts to 100 | Inerts to 100 |

(II) Test Procedures

A 10-cycle spot, film, protein, and lipstick removal test was used to compare formulas 1 and 2 under different test conditions. In this test procedure, clean and milk-coated Libbey glasses were washed in an institutional dish machine (a Hobart C-44) together with a lab soil and the test detergent formula. The concentrations of each were maintained constant throughout the 10-cycle test.

The lab soil used is a 50/50 combination of beef stew and hot point soil. The hot point soil is a greasy, hydrophobic soil made of 4 parts Blue Bonnet all vegetable margarine and 1 part Carnation Instant Non-Fat milk powder.

In the test, the milk-coated glasses are used to test the soil removal ability of the detergent formula, while the initially clean glasses are used to test the anti-redeposition ability of the detergent formula. At the end of the test, the glasses are rated for spots, film, protein, and lipstick removal. The rating scale is from 1 to 5 with 1 being the best and 5 being the worst results.

(III) Test Results

In example 1, formula 1 was compared with formula 2 in the 10-cycle spot, film, protein, and lipstick removal test under 1000 ppm detergent, 500 ppm food soil, and 5.5 grains city water conditions (moderate hardness). The test results are listed in Table 4.

TABLE 4

| | Spots | Film | Protein | Lipstick |
|---|---|---|---|---|
| Formula 1 (Ash) | 3.06 | 1.81 | 3.25 | Not Done |
| Formula 2 (Caustic) | 4.30 | 1.75 | 3.25 | Not Done |

These results show that under low water hardness and normal soil conditions, the ash-based formula 1 performs as well as the caustic-based formula 2.

EXAMPLE 6

In example 6, formula 1 was compared with formula 2 in the 10-cycle spot, film, protein, and lipstick removal test under 1500 ppm detergent, 2000 ppm food soil, and 5.5 grains city water conditions. The test results are listed in Table 5.

TABLE 5

| | Spots | Film | Protein | Lipstick |
|---|---|---|---|---|
| Formula 1 | 3.55 | 1.75 | 3.25 | 1.00 |
| Formula 2 | 3.20 | 2.50 | 3.00 | 5.00 |

These test results show that under low water hardness and heavy soil conditions, higher detergent concentrations can be used to get good spot, film, and protein results that are comparable to those obtained in Example 5. Surprisingly, formula 1 outperformed formula 2 in lipstick removal by a large margin.

EXAMPLE 7

In example 7, formula 1 was compared with formula 2 in the 10-cycle spot, film, protein, and lipstick removal test under 1500 ppm detergent, 2000 ppm food soil, and 18 grains hard water conditions. The test results are listed in Table 6.

TABLE 6

| | Spots | Film | Protein | Lipstick |
|---|---|---|---|---|
| Formula 1 | 3.00 | 3.00 | 4.00 | 1.50 |
| Formula 2 | 5.00 | 3.00 | 5.00 | >5.00 |

These test results show that under high water hardness and heavy soil conditions, cleaning results generally suffer, even with higher detergent concentrations. However, formula 1 outperformed formula 2, especially in lipstick removal.

EXAMPLE 8

In order to evaluate the relative importance of the detergency enhancing surfactant (LF-428, a benzyl capped linear $C_{12-14}$ alcohol 12 mole ethoxylate), and the strong chelating agent (sodium aminotri(methylene phosphonate), in the ash-based detergent, four variations of formula 1 were compared vs. each other under 1000 ppm detergent, 500 ppm food soil, and 5.5 grain city water conditions. The test results are listed in Table 7.

TABLE 7

| | Spots | Film | Protein | Lipstick |
|---|---|---|---|---|
| Formula 1 | 3.25 | 1.75 | 3.25 | 1.00 |
| Formula 1A | 2.50 | 1.50 | 3.25 | 1.00 |
| Formula 1B | 3.00 | 1.50 | 3.25 | 2.00 |
| Formula 1C | 3.00 | 1.50 | 3.50 | 2.00 |

Formula 1A is Formula 1 without nonionic
Formula 1B is Formula 1 without nonionic and sodium aminotri (methylene phosphonate)
Formula 1C is Formula 1 without sodium aminotri(methylene phosphonate)

These test results show that surprisingly the chelating agents cooperate with the alkalinity sources to remove soil such as in lipstick removal.

The foregoing specification, examples and data provide sound basis for understanding the technical advantages of the invention. However, since the invention can comprise a variety of embodiments, the invention resides in the claims hereinafter appended.

We claim:

1. A method of manufacturing a solid detergent composition, which method comprises:

(i) combining:

(a) about 20 to 80 wt % of an alkali metal carbonate;

(b) an effective amount of a solidifying and hardness sequestering agent comprising 1 wt % to 30 wt % of an organic phosphonate; and (c) about 0.01 to 1.3 mole of water per mole of carbonate to form a blended mass; and (ii) forming the blended mass into a solid comprising non-hydrated alkali metal carbonate and a binding agent comprising a mono-hydrated alkali metal carbonate and organic phosphonate for solidification, wherein the mol ratio of alkali metal carbonate to organic phosphonate in the binding agent is in range of about 3:1 to about 7:1;

wherein the solid is substantially free of a source of alkalinity other than an alkali metal carbonate.

2. The method of claim 1 wherein the binding agent comprises a hydrated sodium carbonate and an organic phosphonate.

3. The method of claim 2 wherein the maximum temperature used in the forming method is less than the melting point of the blended hydrated mass.

4. The method of claim 2 wherein the mono-hydrated alkali metal carbonate comprises sodium carbonate and the detergent comprises about 1.5 to 15 wt % of a surfactant which is selected from the group consisting of an anionic surfactant or a nonionic polymeric composition or mixtures thereof.

5. The method of claim 4 wherein the solid detergent composition comprises a nonionic detergent composition.

6. The method of claim 4 wherein the solid detergent comprises an anionic detergent composition.

7. The method of claim 1 wherein the water is present in the detergent in an amount of about 0.9 to less than 1.3 moles of water per each mole of carbonate.

8. The method of claim 1 wherein the blended mass is extruded to form a solid block having a mass greater than 1 kg.

9. The method of claim 1 wherein there is less than 1.25 moles of water per mole of carbonate.

10. The method of claim 1 wherein the solid detergent comprises about 3 to 20 wt % of the organic phosphonate and additionally comprises an inorganic condensed phosphate.

11. The method of claim 10 wherein the inorganic condensed phosphate comprises a sodium tripoly phosphate sequestrant.

12. The method of claim 1 wherein the solidified product is substantially free of $Na_2CO_3.XH_2O$ wherein X is a number that ranges from 2–12.

13. The method of claim 1, wherein the binding agent has a decomposition onset temperature of greater than 120° C.

14. The method of claim 1, further including the step of extruding the blended mass to form a solid block.

15. A solid block warewashing detergent composition comprising;

(a) about 20 to 65 wt % of $Na_2CO_3$;

(b) an effective sequestering amount of a hardness sequestering agent comprising 1 wt % to 30 wt % of an organic phosphonate; and (c) about 0.01 to 1.3 mole of water per mole of sodium carbonate;

wherein the block comprises non-hydrated sodium carbonate and a binding agent comprising mono-hydrated sodium carbonate and organic phosphonate, wherein the mol ratio of alkali metal carbonate to organic phosphonate in the binding agent is in range of about 3:1 to about 7:1, and wherein the block is substantially free of a second source of alkalinity.

16. The composition of claim 15 wherein the block comprises about 0.9 to 1.3 moles of water per mole of sodium carbonate.

17. The composition of claim 15 wherein the detergent comprises about 1.5 to 15 wt % of a surfactant composition which is selected from the group consisting of an anionic surfactant, a nonionic polymeric surfactant, and mixtures thereof.

18. The block of claim 15 wherein the detergent composition is extruded to form the block.

19. The composition of claim 18 wherein the block has a mass greater than about 10 gms.

20. The composition of claim 15 wherein the composition further comprises an anionic detergent composition.

21. The block of claim 15 wherein the composition further comprises a nonionic detergent composition.

22. The block of claim 21 wherein the composition further comprises a nonionic defoaming composition.

23. The block of claim 21 wherein the composition further comprises a nonionic rinse agent.

24. The block of claim 15 wherein the sequestrant also comprises an inorganic condensed phosphate.

25. The block of claim 24 wherein the sequestrant comprises about 3 to 20 wt % of the organic phosphonate, the percentages based on the solid composition, and additionally comprises an effective sequestering amount of a tripolyphosphate sequestrant.

26. The block of claim 15 wherein there are less than about 1.25 moles of water per mole of sodium carbonate.

27. The composition of claim 15, wherein the binding agent has a decomposition onset temperature of greater than 120° C.

28. A solid detergent comprising a product format selected from the group consisting of a pellet and a solid block, the solid detergent comprising:

(a) about 20 to 80 wt % of a $Na_2CO_3$;

(b) an effective amount of a sequestrant comprising 3 wt % to 30 wt % of an organic phosphonate; and (c) an effective amount of a chelating/sequestering agent including a condensed phosphate; wherein the detergent is substantially free of a source of alkalinity other than $Na_2CO_3$ and the detergent comprises about 0.9 to 1.3 moles of water per each mole of carbonate, and a binding agent comprising an organic phosphonate and sodium carbonate monohydrate, wherein the mol ratio of sodium carbonate to organic phosphonate in the binding agent is in range of about 3:1 to about 7:1.

29. The solid of claim 28 wherein the composition is cast in a disposable capsule to solidify.

30. The solid of claim 28 wherein the composition comprises about 1.5 to 15 wt % of a surfactant selected from the group consisting of an anionic surfactant, a nonionic polymeric composition and mixtures thereof.

31. The solid of claim 28 wherein the sequestrant is used in an amount of about 0.5 to 20 wt %.

32. The solid of claim 28 wherein the composition comprises a nonionic detergent composition.

33. The solid of claim 28 wherein the solid block comprises 1 to 45 wt % of an inorganic tripolyphosphate and 3 wt % to 20 wt % of the organophosphonate sequestrant.

34. The solid of claim 33 wherein the solid block comprises less than 1.25 moles of water per mole of sodium carbonate.

35. The composition of claim 28 wherein the solid block comprises an extruded solid block.

* * * * *